US009815485B2

(12) United States Patent
Scheschko et al.

(10) Patent No.: US 9,815,485 B2
(45) Date of Patent: Nov. 14, 2017

(54) METHOD AND DEVICE FOR OUTPUTTING AN ACOUSTIC WARNING SIGNAL OF A RAIL VEHICLE AND WARNING SYSTEM FOR A RAIL VEHICLE

(71) Applicant: Robert Bosch GmbH, Stuttgart (DE)

(72) Inventors: Toni Scheschko, Erdmannhausen (DE); Holger Niemann, Ludwigsburg (DE); Henning Voelz, Stuttgart (DE); Florian Feile, Grossbottwar (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 14/740,884

(22) Filed: Jun. 16, 2015

(65) Prior Publication Data

US 2015/0367871 A1 Dec. 24, 2015

(30) Foreign Application Priority Data

Jun. 20, 2014 (DE) ..... 10 2014 211 851

(51) Int. Cl.

| | |
|---|---|
| ***B61L 13/00*** | (2006.01) |
| ***B61L 15/00*** | (2006.01) |
| ***B61L 3/06*** | (2006.01) |
| ***B61L 23/00*** | (2006.01) |
| ***B61L 23/04*** | (2006.01) |

(52) U.S. Cl.

CPC ..... *B61L 13/002* (2013.01); *B61L 3/065* (2013.01); *B61L 15/009* (2013.01); *B61L 15/0018* (2013.01); *B61L 23/00* (2013.01); *B61L 23/041* (2013.01)

(58) Field of Classification Search

CPC .. B61L 13/002; B61L 15/009; B61L 15/0018; B61L 23/041; B61L 23/00; B61L 3/065

See application file for complete search history.

(56) References Cited

U.S. PATENT DOCUMENTS

| | | | | |
|---|---|---|---|---|
| 4,213,115 | A * | 7/1980 | Wetzel | B60Q 1/46 340/815.72 |
| 5,821,700 | A * | 10/1998 | Malvaso | H05B 39/02 307/10.8 |
| 6,824,110 | B2 * | 11/2004 | Kane | B61L 25/021 246/122 R |
| 9,428,202 | B2 * | 8/2016 | Perras | B61L 25/025 |
| 2004/0230354 | A1 * | 11/2004 | Sollars | B61L 23/00 701/19 |

(Continued)

FOREIGN PATENT DOCUMENTS

| | | |
|---|---|---|
| JP | 2008 215 938 | 9/2008 |
| WO | WO2013/020837 A1 * | 2/2013 |

*Primary Examiner* — Michael J Zanelli

(74) *Attorney, Agent, or Firm* — Norton Rose Fulbright US LLP; Gerard Messina

(57) ABSTRACT

A method for outputting a trigger signal for an acoustic warning signal of a rail vehicle, includes reading in a piece of signal information detected by an image sensor of the rail vehicle, comparing the piece of signal information to at least one stored piece of reference signal information to classify the piece of signal information as a warning sign requiring an output of an acoustic warning signal, and providing a trigger signal to an output unit of the rail vehicle for outputting an acoustic warning signal.

17 Claims, 2 Drawing Sheets

(56) References Cited

U.S. PATENT DOCUMENTS

| | | | | |
|---|---|---|---|---|
| 2005/0110628 | A1* | 5/2005 | Kernwein | B61L 23/00 340/457 |
| 2009/0115633 | A1* | 5/2009 | Lawry | B61L 29/32 340/936 |
| 2009/0276108 | A1* | 11/2009 | Kumar | B61L 23/00 701/20 |
| 2010/0268466 | A1* | 10/2010 | Amutham | B61L 25/025 701/301 |
| 2012/0095627 | A1* | 4/2012 | Matusiak | B61L 23/00 701/19 |

* cited by examiner

METHOD AND DEVICE FOR OUTPUTTING AN ACOUSTIC WARNING SIGNAL OF A RAIL VEHICLE AND WARNING SYSTEM FOR A RAIL VEHICLE

RELATED APPLICATION INFORMATION

The present application claims priority to and the benefit of German patent application no. 10 2014 211 851.4, which was filed in Germany on Jun. 20, 2014, the disclosure of which is incorporated herein by reference.

FIELD OF THE INVENTION

The present invention relates to a method for outputting an acoustic warning signal of a rail vehicle, to a corresponding device, to a warning system for a rail vehicle, and to a corresponding computer program.

BACKGROUND INFORMATION

Assistance systems to assist the driver have been produced in the automotive sector for several years. Various system variants are already believed to be understood, starting from night vision systems or rear view backup cameras which simply depict an image, through surround-view systems which depict the entire 360° surroundings of the vehicle, all the way to systems which use a front camera to automatically recognize traffic signs, traffic lanes, objects and the like.

In rail traffic, important pieces of information are output to the operators of rail vehicles with the aid of signals or mounted or suspended signs. One important signal in this context is the so-called SH-4 "ringing" signal, which prompts the operator to actuate a signaling device of the rail vehicle, which in the case of a street car is the street car bell, for example, to indicate the approaching rail vehicle. JP 2008215938 A discusses a unit for recognizing a railroad signal situated ahead.

SUMMARY OF THE INVENTION

Against this background, the approach described here introduces a method for outputting an acoustic warning signal of a rail vehicle, a device which uses this method, moreover a warning system for a rail vehicle, and finally a corresponding computer program as recited in the main claims. Advantageous embodiments are derived from the particular subclaims and the following description.

Based on a classification of a piece of signal information read in by an image sensor of a rail vehicle, a method provided herein allows an acoustic warning signal to be output automatically to surroundings of the rail vehicle.

As a result of the concept introduced here, it is no longer necessary for an operator of the rail vehicle to bear sole personal responsibility for recognizing a warning signal, such as the SH-4 signal, for example, mounted along the travel track of the rail vehicle. Accidents which are attributable to the vehicle operator overlooking a signal, in combination with carelessness of passersby, may be effectively prevented with the approach introduced here. Such a protective mechanism gains even more in importance when taking into consideration the circumstances that ever more development efforts go toward driving noise minimization, in particular in newer rail vehicles, and that many pedestrians these days use headphones to listen to music, so that rail vehicles, in particular street cars, may be easily overlooked, e.g., on crossings or intersections.

With the concept suggested here, it is possible to automatically recognize rail traffic signals, such as the SH-4 signal, and to trigger an acoustic warning. The warning is thus issued more reliably, and the operator of the rail vehicle is relieved in such situations and is able to concentrate on the surrounding situation to initiate a braking action, if necessary.

A method for outputting a trigger signal for an acoustic warning signal of a rail vehicle is introduced, the method including the following steps:

- reading in a piece of signal information detected by an image sensor of the rail vehicle;
- comparing the piece of signal information to at least one stored piece of reference signal information to classify the piece of signal information as a warning sign requiring an output of an acoustic warning signal; and
- providing a trigger signal to an output unit of the rail vehicle for outputting an acoustic warning signal.

The rail vehicle may be a rail-bound vehicle, such as a street car guided in grooved rails, or a train guided on rail tracks. The rail vehicle may be operated with electrical energy. The acoustic warning signal may be provided by the output unit of the rail vehicle as a ringing or bell sound which is clearly audible for passersby and/or operators of further vehicles, the sound providing a warning about the approaching rail vehicle. The image sensor may form part of the camera system installed in the motor car of the rail vehicle for recording images of surroundings of the rail vehicle. The piece of signal information may be understood to mean a text and/or an icon on a traffic or signal sign mounted along a travel track of the rail vehicle. The piece of reference signal information may include comparative data with respect to the piece of signal information, for example for ascertaining a content of the piece of signal information using an algorithm. A warning sign as a traffic or signal sign may be understood to mean an indication about the acoustic warning signal of an approaching rail vehicle. The output unit may be a speaker or a ringing signal device situated on the outside of the rail vehicle.

According to one specific embodiment of the method, the piece of signal information may be compared in the step of comparing to the at least one stored piece of reference signal information, using a predefined pattern recognition algorithm, to identify the piece of signal information as the warning sign. In this way, the piece of signal information may be classified particularly quickly as a warning sign.

Moreover, the method may include a step of assigning the piece of signal information to a travel track of the rail vehicle. Correspondingly, the trigger signal may be provided in the step of providing if, in the step of assigning, a position of the piece of signal information is assigned to at least one rail on which the vehicle is being driven. The position of the piece of signal information may be determined with the aid of GPS, for example. The travel track may be understood to mean a rail track extending ahead of the rail vehicle and on which the rail vehicle is to be driven. This specific embodiment of the method may help ensure that the detected piece of signal information is in fact valid for the travel track on which the rail vehicle is presently being driven. In this way faulty activations of the acoustic warning signal may be effectively avoided.

In particular, the piece of signal information may be assigned in the step of assigning to the at least one rail on which the vehicle is being driven if a distance of the position of the piece of signal information from the rail is within a predefined distance range. This specific embodiment may be used to readily verify the validity of the piece of signal information for the travel track being driven on.

According to one further specific embodiment, the trigger signal may be provided in the step of providing to an output unit of the rail vehicle configured as a ringing signal device. The ringing signal device may be configured to output a ringing signal as the acoustically perceptible warning signal in response to the trigger signal. The ringing signal device may be a street car bell, for example, or a signaling device of a commuter or railroad train. In this way, the warning associated with the piece of signal information may be provided to passersby and/or vehicle operators in a clearly audible manner in the potential hazard area of the rail vehicle.

Moreover, a device for outputting a trigger signal for an acoustic warning signal of a rail vehicle is introduced, the device including the following features:

a read-in unit for reading in a piece of signal information detected by an image sensor of the rail vehicle;

a comparison unit for comparing the piece of signal information to at least one stored piece of reference signal information to classify the piece of signal information as a warning sign requiring an output of an acoustic warning signal; and a provision unit for providing a trigger signal to an output unit of the rail vehicle to output an acoustic warning signal.

The device may be configured to carry out, activate or implement the steps of one variant of the method introduced herein in its corresponding units. The object of the present invention may also be achieved quickly and efficiently by this embodiment variant of the present invention in the form of a device.

The device in the present invention may be understood to mean an electrical device which processes sensor signals and outputs control and/or data signals as a function thereof. The device may include an interface which may be configured as hardware and/or software. In the case of a hardware configuration, the interfaces may, for example, be part of a so-called system ASIC which includes a wide variety of functions of the device. However, it is also possible for the interfaces to be separate integrated circuits, or to be at least partially composed of discrete components. In the case of a software configuration, the interfaces may be software modules which are present on a microcontroller, for example, in addition to other software modules.

Moreover a warning system for a rail vehicle is introduced, the warning system including the following features:

a device for outputting an acoustic warning signal according to one of the specific embodiments described above;

an image sensor coupled or coupleable to the device for detecting the piece of signal information; and an output unit coupled or coupleable to the device, which may be situated on the rail vehicle directed at outside surroundings of the rail vehicle and which is configured to output the acoustic warning signal in response to the trigger signal.

Using the warning system, the above-described method for outputting an acoustic warning signal may advantageously be used to clearly inform road users situated in a hazard area of the rail vehicle about the approaching rail vehicle in a timely manner.

In addition, a computer program product or computer program is advantageous, having program code which may be stored on a machine-readable carrier or storage medium such as a semiconductor memory, a hard disk memory or an optical memory, and which is used to carry out, implement and/or activate the steps of the method according to one of the specific embodiments described above, in particular if the program product or program is executed on a computer or a device.

The approach introduced here is described in greater detail hereafter based on the accompanying drawings by way of example.

DETAILED DESCRIPTION

Figure 1:
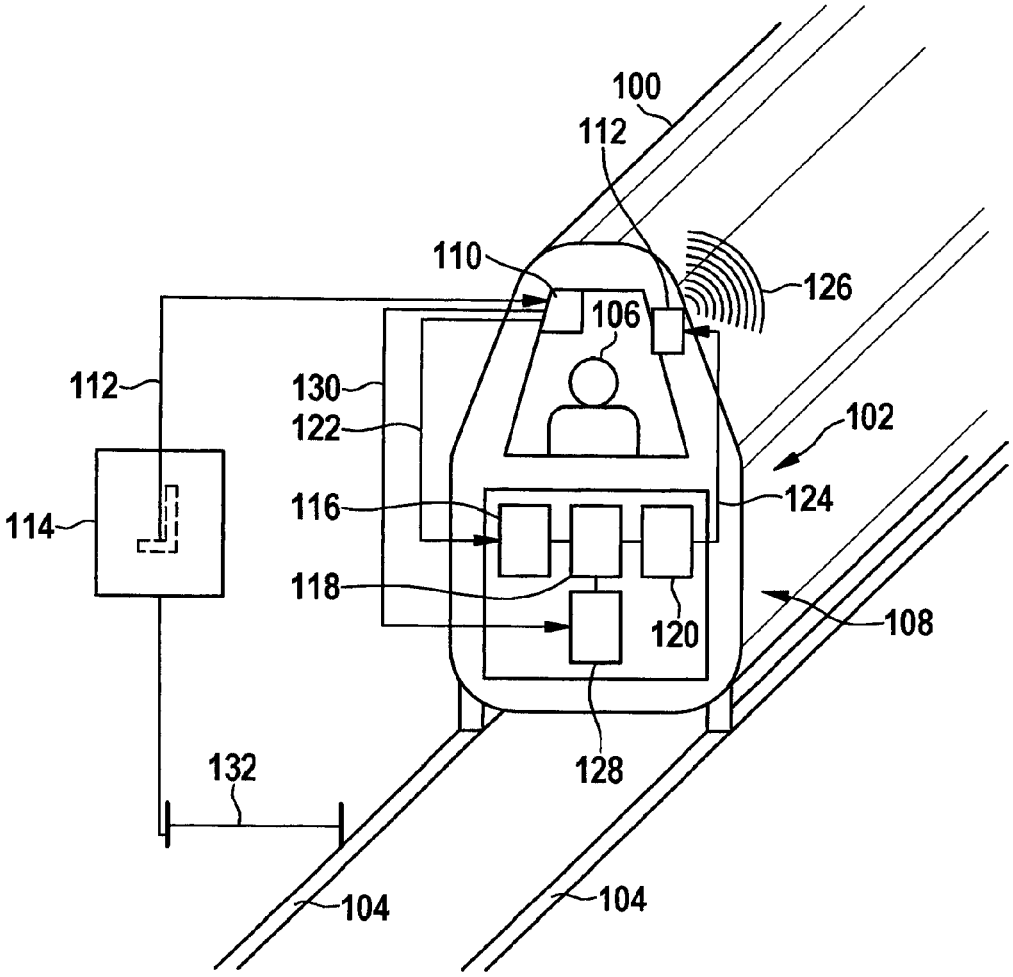
FIG. 1 shows a schematic illustration of a rail vehicle including a warning system according to one exemplary embodiment of the present invention.

In the following description of favorable exemplary embodiments of the present invention, identical or similar reference numerals are used for similarly acting elements shown in the different figures, and a repeated description of these elements is dispensed with.

Based on a schematically illustrated traffic situation, FIG. 1 shows an exemplary rail vehicle 100, which is equipped with a warning system 102 according to one exemplary embodiment of the present invention. Rail vehicle 100 is a street car in the exemplary embodiment shown in FIG. 1. Rail vehicle 100 may alternatively also be another rail-bound vehicle, such as a railroad or commuter train. Street car 100 is guided on two tracks or grooved rails 104 extending in parallel. An operator 106 of the street car, who is usually situated in an operator's cab at the very front in rail vehicle 100 and has a view of the surroundings, in particular a travel track, of rail vehicle 100 through a windshield, has the task to regulate in particular a driving speed and to observe and implement driving signals displayed alongside the track.

Warning system 102 includes a device 108 for outputting a trigger signal for an acoustic warning signal of rail vehicle 100, an image sensor 110 coupled to the device, and an output unit 112 also coupled to device 108. Image sensor 110 forms part of a camera installed in the operator's cab of street car 100, in particular a video camera, which is configured to continuously visually detect surroundings of the street car during its trip.

In the scenario of a trip of rail vehicle 100 shown in FIG. 1, image sensor 110 detects image data 112 of a sign or signal 114 mounted along the travel track of rail vehicle 110. In the scenario shown in FIG. 1, signal 114 is a so-called SH-4 "ringing" signal, characterized by the letter L on the signal post. During operation of the street car, SH-4 "ringing" signal 114 prompts operator 106 of street car 100 to actuate the foot-operated bell of street car 100 to draw the attention of other road users presently situated in the surroundings of street car 100 to approaching street car 100 with the aid of a warning signal output via speaker 112. The warning signal may be output as a clearly audible bell tone, for example. Output unit 112 is an acoustic output unit, which is situated on rail vehicle 100 directed at the outside surroundings of rail vehicle 100 and configured to output the acoustic warning signal in response to the trigger signal of the device.

Device 108 may be a central control unit of rail vehicle 100. Alternatively, device 108 may also be coupled to a central control unit of rail vehicle 100, for example via a bus system of rail vehicle 100. Device 108 includes a read-in unit 116, a comparison unit 118, and a provision unit 120. Read-in unit 116 is configured to read in a piece of signal information 122 from image sensor 110 which is based on detected image data 112.

Comparison unit 118 is configured to compare the piece of signal information 122 to pieces of reference signal information to determine whether the piece of signal information 122 is a warning sign which requires the acoustic warning signal to be output. The pieces of reference signal information are stored in a memory unit (not shown) of device 108 in the exemplary embodiment of device 108 shown in FIG. 1. The stored pieces of reference signal information may be a list of all contents of signals or signs used in rail traffic. According to the exemplary embodiments, comparison unit 118 may use a predefined pattern recognition algorithm to classify the piece of signal information 122.

If the piece of signal information 122 is classified in comparison unit 118 as a warning sign requiring the acoustic warning signal to be output, provision unit 120 provides a trigger signal 124 to output unit 112 of rail vehicle 100. In the exemplary embodiment shown in FIG. 1, output unit 112 is implemented as a ringing signal unit having a speaker and is configured to output an acoustically perceptible warning signal 126—here, as a ringing signal corresponding to a bell sound of a foot-operated bell of street car 100—in response to trigger signal 124, in order to draw the attention of further road users potentially situated in the area of street car 100 to approaching street car 100.

In the exemplary embodiment shown in FIG. 1, device 108 furthermore includes an assignment unit 128. Assignment unit 128 is configured to assign the piece of signal information 122 contained in signal 114 to a travel track of rail vehicle 100 to ensure that the detected piece of signal information 122 is in fact valid for rail vehicle 100 passing it, and that it is not perhaps assigned to another travel track on which rail vehicle 100 is not being driven.

In the exemplary embodiment shown in FIG. 1, assignment unit 128 is configured to assign the piece of signal information 122 to at least one rail 104 on which rail vehicle 100 is being driven, based on surroundings data 130 of surroundings of rail vehicle 100, in particular surroundings situated ahead of rail vehicle 100, provided by image sensor 110, if a distance 132 of a position of the piece of signal information 122 or of signal 114 from rail 104 is within a predefined distance range. The position of the piece of signal information 122 or of signal 114 may be determined with the aid of GPS, for example. Correspondingly, in the exemplary embodiment shown in FIG. 1, provision unit 120 is configured to provide trigger signal 124 furthermore based on the assignment of the piece of signal information 122 to the travel track of rail vehicle 100.

As the illustration in FIG. 1 shows, the detection of the obstacle or of signal 114 carrying the piece of signal information 122 is carried out using the video camera or image sensor 110 on the front of vehicle 100. Using camera 110, optionally a rail detection may be carried out with the aid of assignment unit 128, so that signal 114 is clearly assigned to the host travel track. Using the video image, it is now possible to carry out the classification on whether or not an SH-4 signal is involved. This classification may be carried out using algorithms from the pattern recognition, as they are known, e.g., from automotive traffic sign recognition or facial recognition software. Examples of these are neuronal networks or Viola-Jones methods. The representation of the exemplary traffic scenario in FIG. 1 illustrates the concept suggested herein of recognizing and classifying the SH-4 "ringing" signal 114 with the aid of a sensor system, which includes at least camera 110, for example, and carrying out an automatic acoustic warning.

Figure 2:
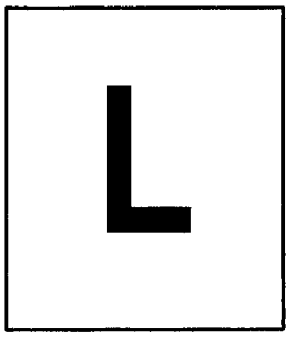
FIG. 2 shows an exemplary warning signal for a rail vehicle.

FIG. 2 shows an exemplary warning signal for a rail vehicle. It shows SH-4 "ringing" signal 114, which shows the capital letter L as a prompt to ring the street car bell. SH-4 "ringing" signal 114 identifies a point on the track at which an acoustic signal must be output. This may be triggered manually—in most cases by an operator of the rail vehicle by actuating a foot-operated bell—or automatically with the aid of the device provided herein. The exemplary SH-4 "ringing" signal 114 shown in FIG. 2 is suspended in the visual range of an operator or of an image sensor of a rail vehicle on a holding cable extending transversely across a travel track of the rail vehicle.

Figure 3:
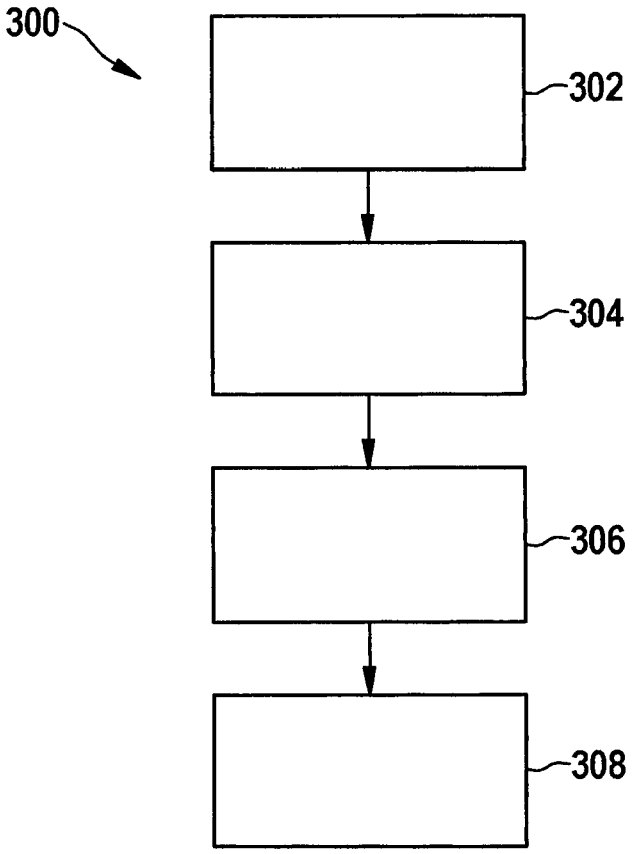
FIG. 3 shows a flow chart of a method for outputting an acoustic warning signal of a rail vehicle according to one exemplary embodiment of the present invention.

FIG. 3 shows a flow chart of one exemplary embodiment of a method 300 for detecting an obstacle in the form of an SH-4 "ringing" signal and automatic triggering of an acoustic warning signal for rail vehicles. Method 300 may be carried out by a device introduced based on FIG. 1 for outputting a trigger signal for an acoustic warning signal of a rail vehicle. In a step 302, a piece of signal information detected by an image sensor of the rail vehicle is read in. In a step 304, the piece of signal information is compared to a piece of reference signal information stored in a memory unit of the device to classify the piece of signal information as a warning sign requiring an output of an acoustic warning signal. In an optional step 306, the piece of signal information is assigned to a travel track of the rail vehicle with the aid of a rail detection. If, in step 304, the obstacle is classified as the SH-4 signal and optionally, in step 306, the piece of signal information is assigned to a travel track of the rail vehicle, a trigger signal is provided in a step 308 to an output unit of the rail vehicle to automatically trigger a (street car) bell in order to output the acoustic warning signal.

The described exemplary embodiments shown in the figures are selected only by way of example. Different exemplary embodiments may be combined with each other completely or with respect to individual features. It is also possible to supplement one exemplary embodiment with features of another exemplary embodiment.

Moreover, the method steps introduced here may be carried out repeatedly and in a different order than the one described.

If one exemplary embodiment includes an "and/or" linkage between a first feature and a second feature, this should be read in such a way that the exemplary embodiment according to one specific embodiment includes both the first feature and the second feature, and according to an additional specific embodiment includes either only the first feature or only the second feature.

What is claimed is:

1. A method for outputting a trigger signal for an acoustic warning signal of a rail vehicle, the method comprising:

reading in a piece of signal information detected by an image sensor of the rail vehicle;

comparing the piece of signal information to at least one stored piece of reference signal information to classify the piece of signal information as a warning sign requiring an output of an acoustic warning signal;

assigning the piece of signal information to a travel track of the rail vehicle with the aid of a global positioning system to determine a position of the piece of signal information; and automatically providing, without operator intervention, a trigger signal to an output unit of the rail vehicle to output an acoustic warning signal directed at outside surroundings of the rail vehicle, when a result of the comparing indicates the acoustic warning signal is required and the position of the piece of signal information is assigned in the assigning to at least one rail on which the rail vehicle is being driven.

2. The method of claim 1, wherein the piece of signal information is compared in the comparing to the at least one stored piece of reference signal information, using a predefined pattern recognition algorithm, to identify the piece of signal information as the warning sign.

3. The method of claim 1, wherein the piece of signal information is assigned in the assigning to the at least one rail on which the rail vehicle is being driven if a distance of the position of the piece of signal information from the rail is within a predefined distance range.

4. The method of claim 1, wherein the trigger signal is provided in the providing task to an output unit of the rail vehicle configured as a ringing signal unit, the ringing signal unit being configured to output a ringing signal as the acoustically perceptible warning signal in response to the trigger signal.

5. The method of claim 1, wherein the acoustic warning signal is acoustically-perceptible in the outside surroundings of the rail vehicle.

6. The method of claim 1, wherein the output unit includes a speaker on the outside of the rail vehicle which directs the acoustic warning signal to the outside surroundings of the rail vehicle.

7. The method of claim 1, wherein the acoustic warning signal is a ringing sound.

8. A device for outputting a trigger signal for an acoustic warning signal of a rail vehicle, comprising:

a read-in unit to read in a piece of signal information detected by an image sensor of the rail vehicle;

a comparison unit to compare the piece of signal information to at least one stored piece of reference signal information to classify the piece of signal information as a warning sign requiring an output of an acoustic warning signal;

an assignment unit to assign the piece of signal information to a travel track of the rail vehicle with the aid of a global positioning system to determine a position of the piece of signal information; and a provision unit to automatically provide, without operator intervention, a trigger signal to an output unit of the rail vehicle to output an acoustic warning signal directed at outside surroundings of the rail vehicle, when a result of the compare indicates that the acoustic warning signal is required and the position of the piece of signal information is assigned in the assign to at least one rail on which the rail vehicle is being driven.

9. The device of claim 8, wherein the acoustic warning signal is acoustically-perceptible in the outside surroundings of the rail vehicle.

10. The device of claim 8, wherein the output unit includes a speaker on the outside of the rail vehicle which directs the acoustic warning signal to the outside surroundings of the rail vehicle.

11. A warning system for a rail vehicle, comprising:

a device for outputting a trigger signal for an acoustic warning signal of a rail vehicle, including:

a read-in unit to read in a piece of signal information detected by an image sensor of the rail vehicle;

a comparison unit to compare the piece of signal information to at least one stored piece of reference signal information to classify the piece of signal information as a warning sign requiring an output of an acoustic warning signal;

an assignment unit to assign the piece of signal information to a travel track of the rail vehicle with the aid of a global positioning system to determine a position of the piece of signal information; and a provision unit to automatically provide, without operator intervention, a trigger signal to an output unit of the rail vehicle to output an acoustic warning signal, when a result of the compare indicates that the acoustic warning signal is required and the position of the piece of signal information is assigned in the assign to at least one rail on which the rail vehicle is being driven;

an image sensor, coupled or coupleable to the device, for detecting the piece of signal information; and an output unit, coupled or coupleable to the device, which is situatable on the rail vehicle directed at outside surroundings of the rail vehicle and which is configured to output the acoustic warning signal in response to the trigger signal.

12. The warning system of claim 11, wherein the piece of signal information is compared in the comparing to the at least one stored piece of reference signal information, using a predefined pattern recognition algorithm, to identify the piece of signal information as the warning sign.

13. The warning system of claim 11, wherein the acoustic warning signal is acoustically-perceptible in the outside surroundings of the rail vehicle.

14. The warning system of claim 11, wherein the output unit includes a speaker on the outside of the rail vehicle which directs the acoustic warning signal to the outside surroundings of the rail vehicle.

15. A non-transitory machine-readable storage medium having a computer program, which is executable by a processor, comprising:

a program code arrangement having program code for outputting a trigger signal for an acoustic warning signal of a rail vehicle, by performing the following:

reading in a piece of signal information detected by an image sensor of the rail vehicle;

comparing the piece of signal information to at least one stored piece of reference signal information to classify the piece of signal information as a warning sign requiring an output of an acoustic warning signal;

assigning the piece of signal information to a travel track of the rail vehicle with the aid of a global positioning system to determine a position of the piece of signal information; and automatically providing, without operator intervention, a trigger signal to an output unit of the rail vehicle to output an acoustic warning signal directed at outside surroundings of the rail vehicle, when a result of the comparing indicates that the acoustic warning signal is required and the position of the piece of signal information is assigned in the assigning to at least one rail on which the rail vehicle is being driven.

16. The storage medium of claim 15, wherein the acoustic warning signal is acoustically-perceptible in the outside surroundings of the rail vehicle.

17. The storage medium of claim 15, wherein the output unit includes a speaker on the outside of the rail vehicle which directs the acoustic warning signal to the outside surroundings of the rail vehicle.

* * * * *